US011454362B2

(12) United States Patent
Chen

(10) Patent No.: US 11,454,362 B2
(45) Date of Patent: Sep. 27, 2022

(54) LAMP ASSEMBLY AND EMERGENCY LAMP COMPRISING THE SAME

(71) Applicant: Je Woo Corporation, Ltd., Huizhou (CN)

(72) Inventor: Huashui Chen, Huizhou (CN)

(73) Assignee: JE WOO CORPORATION, LTD., Huizhou (CN)

( * ) Notice: Subject to any disclaimer, the term of this patent is extended or adjusted under 35 U.S.C. 154(b) by 0 days.

(21) Appl. No.: 17/237,084

(22) Filed: Apr. 22, 2021

(65) Prior Publication Data

US 2022/0136667 A1 May 5, 2022

(30) Foreign Application Priority Data

Oct. 29, 2020 (CN) ..... 202011180923.1

(51) Int. Cl.

| | |
|---|---|
| ***F21S 9/02*** | (2006.01) |
| ***F21V 14/06*** | (2006.01) |
| ***F21V 17/02*** | (2006.01) |
| ***F21V 17/18*** | (2006.01) |
| ***F21Y 115/10*** | (2016.01) |

(52) U.S. Cl.

CPC ..... *F21S 9/022* (2013.01); *F21V 14/06* (2013.01); *F21V 17/02* (2013.01); *F21V 17/18* (2013.01); *F21Y 2115/10* (2016.08)

(58) Field of Classification Search

CPC ..... F21S 9/022; F21S 9/024; F21V 17/18; F21V 14/06

See application file for complete search history.

(56) References Cited

U.S. PATENT DOCUMENTS

| | | | | |
|---|---|---|---|---|
| 9,080,747 | B1 * | 7/2015 | Hetrick | F21V 5/08 |
| 9,429,298 | B1 * | 8/2016 | Hetrick | F21S 9/022 |
| 9,625,125 | B1 * | 4/2017 | Bryant | F21S 8/033 |
| 10,323,829 | B1 * | 6/2019 | Zauhar | F21V 29/70 |
| 2007/0236931 | A1 * | 10/2007 | Chien | F21S 8/035 362/249.07 |

FOREIGN PATENT DOCUMENTS

| | | | | |
|---|---|---|---|---|
| WO | WO-2005124222 | A1 * | 12/2005 | F21V 29/503 |
| WO | WO-2020253526 | A1 * | 12/2020 | F21V 14/06 |

* cited by examiner

*Primary Examiner* — Alexander K Garlen

(74) *Attorney, Agent, or Firm* — Matthias Scholl P.C.; Matthias Scholl

(57) ABSTRACT

A lamp assembly including a front cover, a lens assembly, a light-emitting assembly, and a rear cover. The front cover and the rear cover are connected to each other to form a cavity, and the lens assembly and the light-emitting assembly are disposed in the cavity. The front cover includes a first chamber. The first chamber runs through the front cover and the lens assembly is disposed in the first chamber. The lens assembly includes a rotation trough and at least one lens. The rotation trough includes an end face, a second chamber, and an opening, and the at least one lens is disposed in the second chamber. The opening of the rotation trough is disposed towards the light-emitting assembly. A transparent plate is connected to the end face, and one end of the at least one lens is connected to the transparent plate.

10 Claims, 7 Drawing Sheets

LAMP ASSEMBLY AND EMERGENCY LAMP COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 202011180923.1 filed Oct. 29, 2020, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to a lamp assembly and an emergency lamp comprising the same.

Conventionally, when an emergency lamp is used for long-distance lighting, the beam angle of the emergency lamp is small; when use for short-distance lighting, the beam angle of the emergency lamp is large. However, the beam angle of existing emergency lamps cannot be adjusted.

SUMMARY

The disclosure provides a lamp assembly, comprising a front cover; a lens assembly; a light-emitting assembly; and a rear cover. The front cover and the rear cover are connected to each other to form a cavity, and the lens assembly and the light-emitting assembly are disposed in the cavity; the front cover comprises a first chamber; the first chamber runs through the front cover and the lens assembly is disposed in the first chamber. The light-emitting assembly is configured to provide a light source, and the lens assembly is configured to enhance the use efficiency and luminous efficiency of light and to adjust the luminous angle of light.

In a class of this embodiment, the lens assembly comprises a rotation trough and at least two lenses; the rotation trough comprises an end face, a second chamber, and an opening, and the at least two lenses are disposed in the second chamber; the opening of the rotation trough is disposed towards the light-emitting assembly; a transparent plate is connected to the end face, and one end of each of the at least two lenses is connected to the transparent plate; the light-emitting assembly comprises at least one light-emitting diode (LED), and the number of the at least two lenses is twice that of the at least one LED, thus ensuring each LED corresponds to at least one lens. The rotation trough is rotatable with respect to the light-emitting assembly, and a projection of a rotation path of all of the at least two lenses on the light-emitting assembly covers the at lest one LED. By rotating the rotation trough, the rotation trough drives the lens to rotate, and the adjacent lens of different specifications will replace the previous lens to face the LED. To prevent the lens from rubbing with the LED during the rotation process and causing damage to the LED, there is a small gap between the lens and the LED, so that the lens does not contact with the LED. The lens of different specifications can make the LED light emitted at different angles. The luminous angle can be adjusted by rotating the rotation trough.

In a class of this embodiment, the lens is a catadioptric polycarbonate (PC) lens.

In a class of this embodiment, the central axis of the transparent plate coincides with the central axis of the rotation trough; an end face of the transparent plate and an end face of the rotation trough away from the light-emitting assembly form a step; the end face of the transparent plate away from the light-emitting assembly protrudes to form a plurality of adjusting blocks. The plurality of adjusting blocks are distributed around the axis of the transparent plate, and the operator turns the rotation trough by adjusting the adjusting blocks.

In a class of this embodiment, the front cover further comprises a clamping block circumferentially disposed on one end of the first chamber away from the light-emitting assembly, and the clamping block is in contact with the step; an edge of the end face of the rotation trough away from the light-emitting assembly comprises a plurality of arc grooves; the clamping block comprises a plurality of arc protrusions raised towards the rotation trough; and the plurality of arc protrusions is disposed in the plurality of arc grooves, respectively. When the operator does not rotate the rotation trough, the plurality of arc grooves blocks the rotation trough through the groove to prevent the rotation of the rotation trough; when the operator applies external force to rotate the rotation trough, the arc groove is separated from the engaged arc protrusions and engaged with the adjacent arc protrusion along the rotation direction, and when the groove is engaged with the adjacent arc protrusion, a vibration is fed back to the operator, so that the operator can feel the rotation is completed. By setting the radian between the adjacent arc protrusions and the radian between the adjacent arc grooves, the rotation angle of the rotation trough can be set.

In a class of this embodiment, to facilitate the operator to directly observe the change of the beam angle by rotating the rotation trough, the end face of the transparent plate away from the light-emitting assembly comprises an indicating block, and an end face of the front cover away from the rear cover comprises a plurality of identification protrusions; and the indicating block is aligned with one of the plurality of identification protrusions in a radial direction.

In a class of this embodiment, the side wall of the first chamber of the front cover comprises at least two locating slots, and the side wall of the light-emitting assembly protrudes to form at least two locating blocks; the at least two locating blocks are disposed in the at least two locating slots, respectively.

In a class of this embodiment, the side wall of the first chamber of the front cover comprises at least two through holes, and the side wall of the rear cover comprises at least two raised blocks; the at least two raised blocks are disposed in the at least two through holes, respectively. In this way, the front cover of the lamp assembly is connected to the rear cover in a snap-fastening mode, thus fixing the lens assembly and the light-emitting assembly.

In a class of this embodiment, the rear cover comprises an opening facing the light-emitting assembly and a base plate; the base plate comprises a plurality of support rods, and the plurality of support rods abuts against an end face of the light-emitting assembly. The arrangement of the support rods leads to a gap between the bottom surface of the rear cover and the end surface of the light-emitting assembly, which is conducive to the heat dissipation of the light-emitting assembly.

In a class of this embodiment, the light-emitting assembly comprises three light-emitting diodes disposed circumferentially along the central axis of the light-emitting assembly, and six lenses are disposed circumferentially along the central axis of the transparent plate. Specifically, the lens assembly comprises two specifications of the lenses, and three lenses for each specification. Two sides of one specification of the lens is provided with another specification of two lenses. By rotating the rotation trough clockwise, the three LEDs are matched with the three lenses of one specification to emit light of one angle. By rotating the rotation trough counterclockwise, the three LEDs are matched with the three lenses of the other specification to emit light of another angle.

In another aspect, the disclosure provides an emergency lamp comprising the aforesaid lamp assembly.

In a class of this embodiment, the emergency lamp comprises two lamp assemblies, and the central axes of two transparent plates of the two lamp assemblies form an included angle. The lamp assemblies irradiate in different directions thus expanding the lighting range of the emergency lamp.

The beam angle of the emergency lamp is adjustable by manually rotating the lens. The beam angle of the lamp can switch between at least two different angles, so that the emergency lamp can be used for long-distance lighting and short-distance lighting or development area lighting at the same time, which improves the applicability of the emergency lamp.

DETAILED DESCRIPTION

Figure 1:
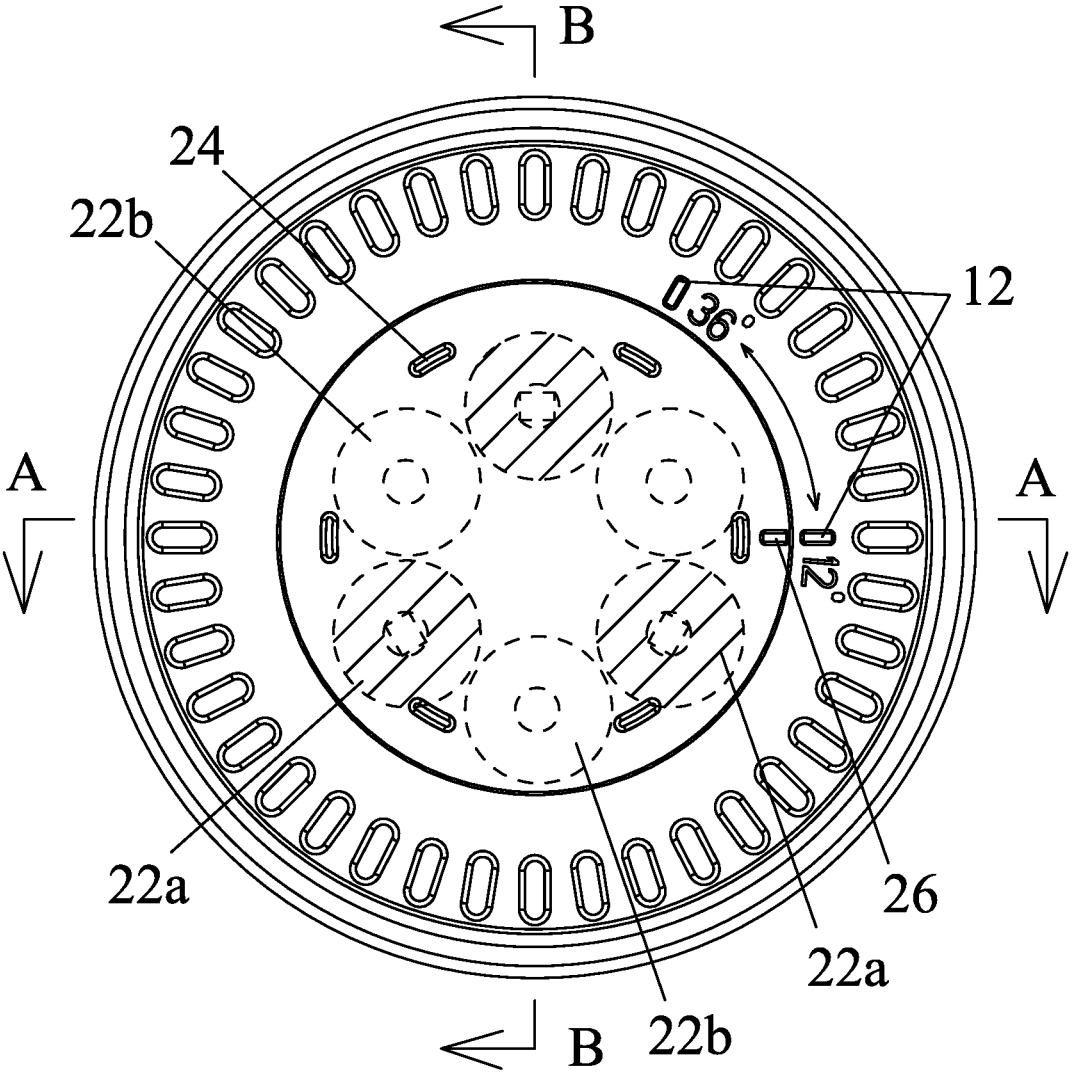
FIG. 1 is a front view of a lamp assembly according to one embodiment of the disclosure.
Figure 2:
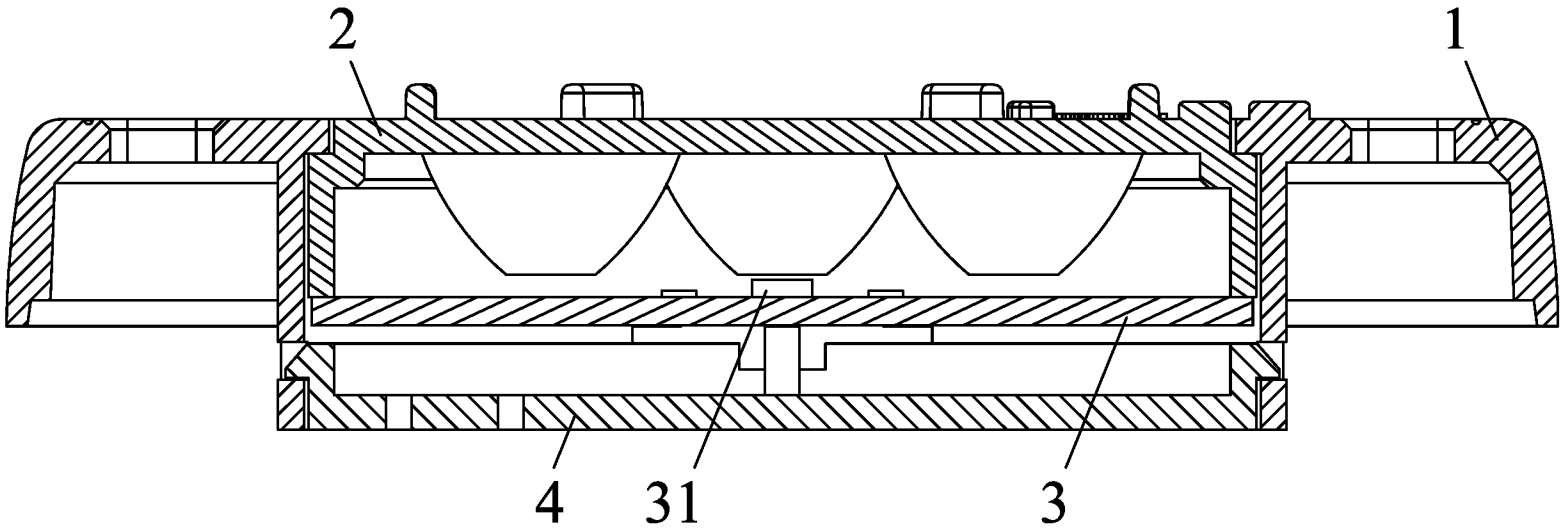
FIG. 2 is a sectional view taken from line A-A in FIG. 1.
Figure 3:
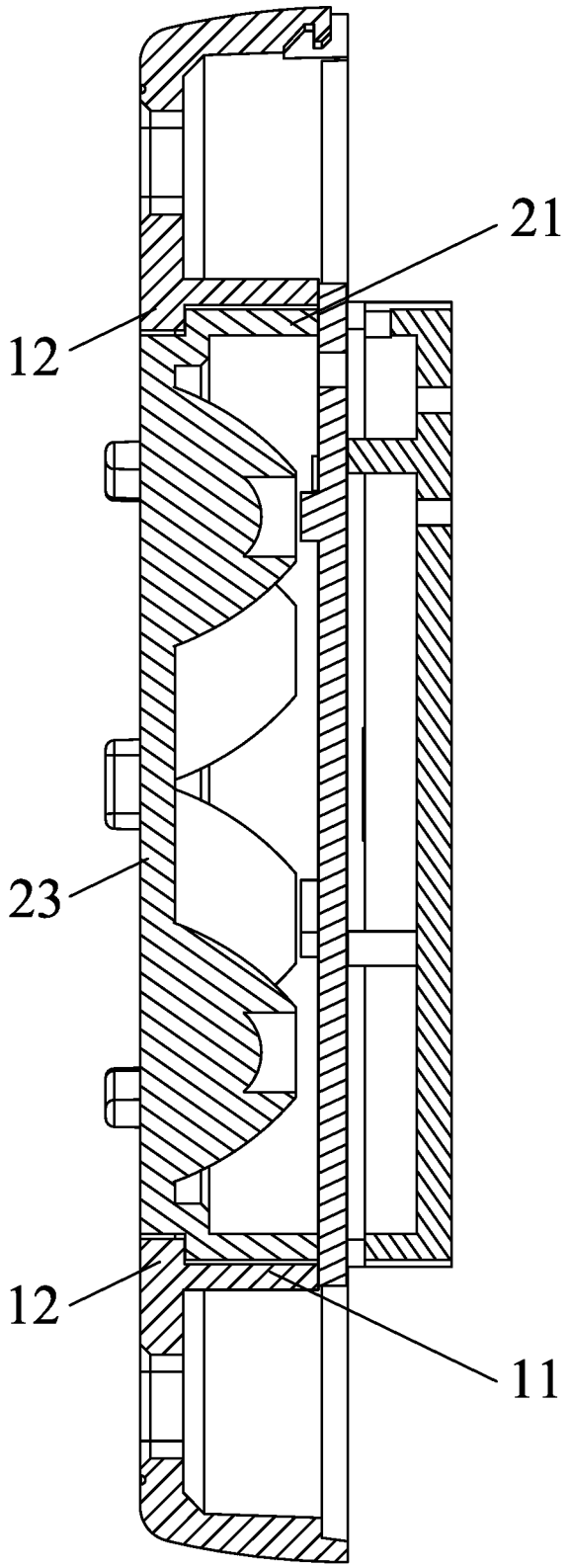
FIG. 3 is a sectional view taken from line B-B in FIG. 1.
Figure 4:
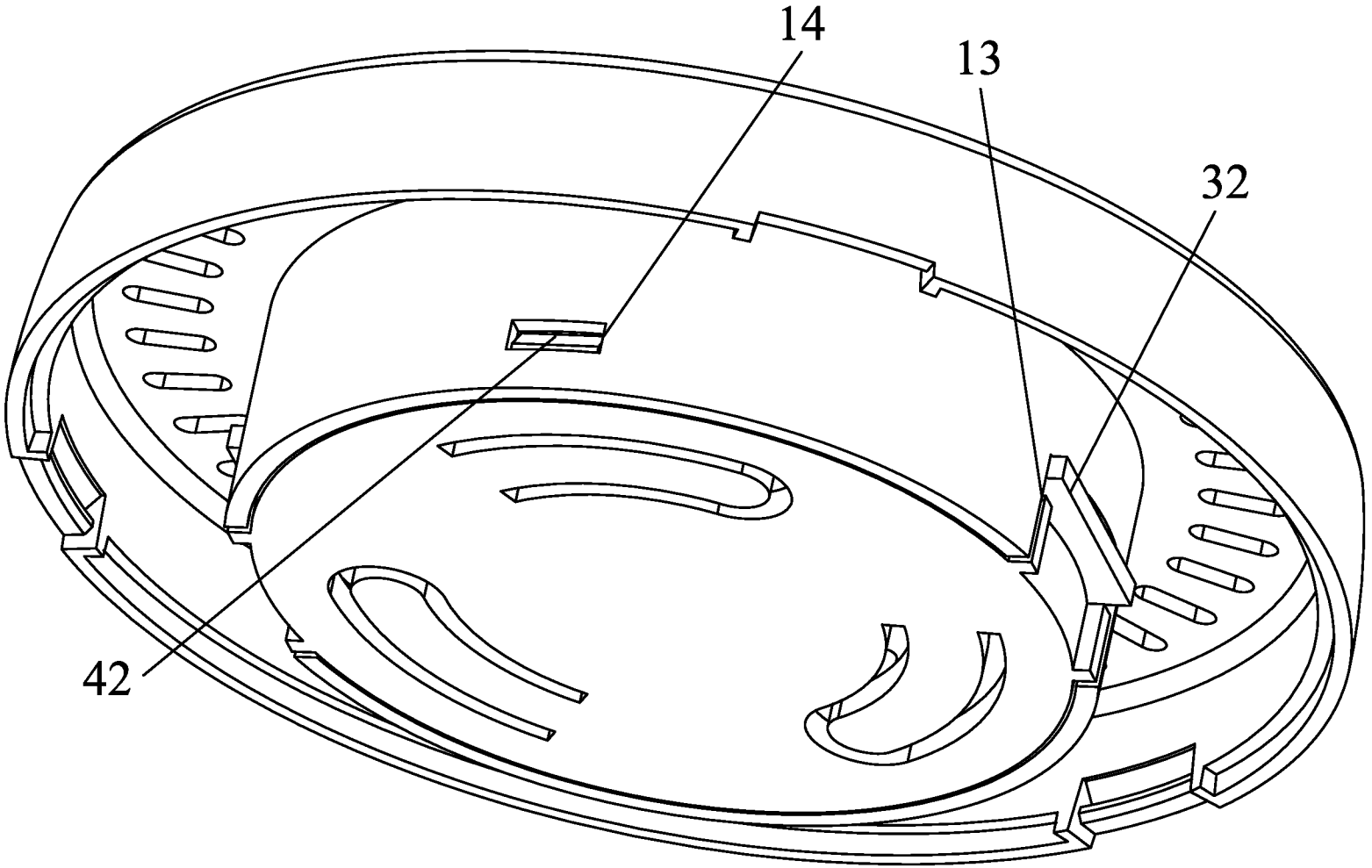
FIG. 4 is a schematic diagram of a lamp assembly according to one embodiment of the disclosure.
Figure 5:
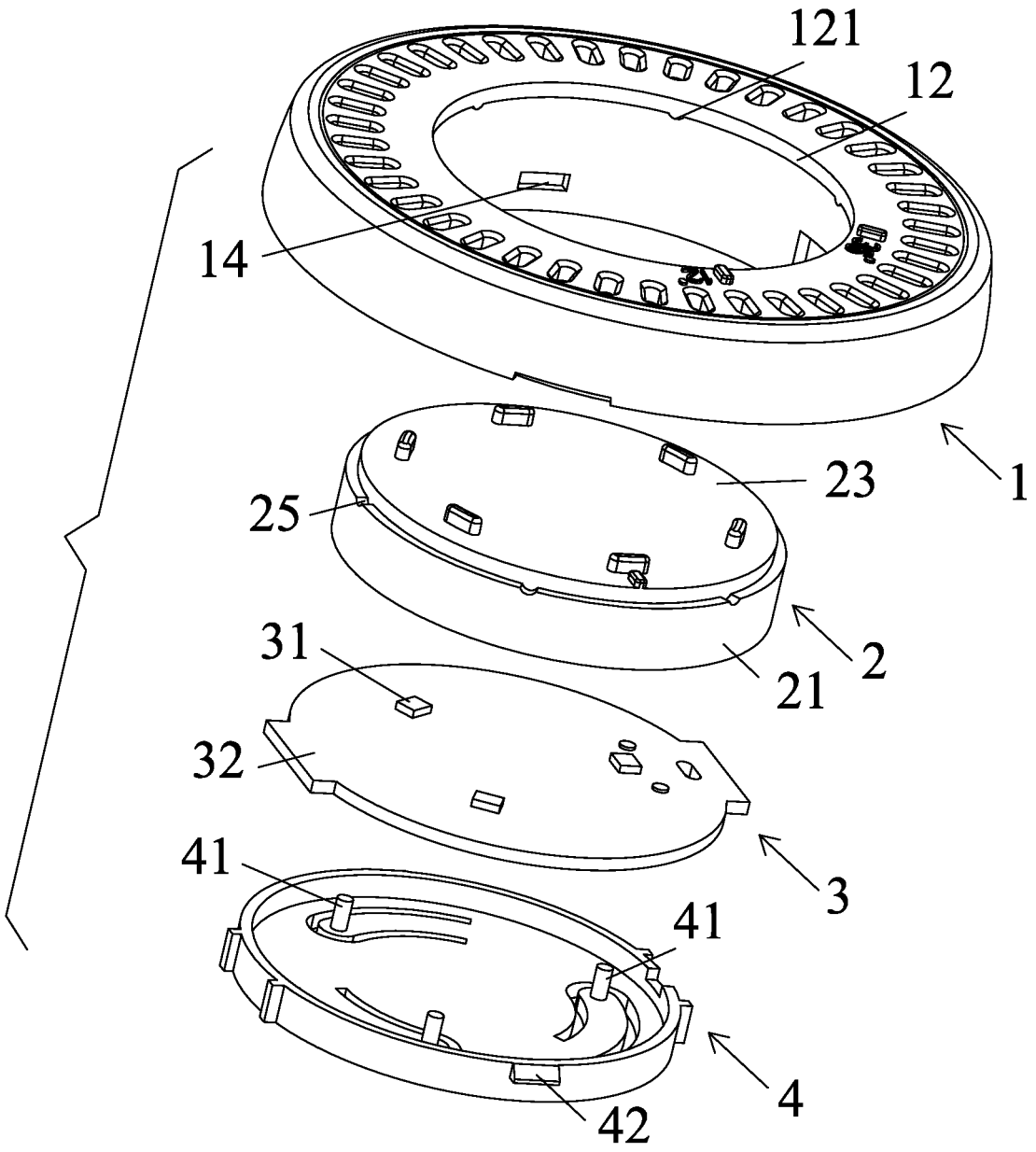
FIG. 5 is an exploded view of a lamp assembly according to one embodiment of the disclosure.

To further illustrate, embodiments detailing a lamp assembly and an emergency lamp comprising the same are described below. It should be noted that the following embodiments are intended to describe and not to limit the disclosure.

As shown in FIGS. 1-5, the disclosure provides a lamp assembly comprising a front cover 1, a lens assembly 2, a light-emitting assembly 3, and a rear cover 4. The front cover 1 and the rear cover 4 are connected to each other to form a cavity, and the lens assembly 2 and the light-emitting assembly 3 are disposed in the cavity. The front cover 1 comprises a first chamber 11. The first chamber 11 runs through the front cover and the lens assembly 2 is disposed in the first chamber 11. The lens assembly 2 comprises a rotation trough 21 and at least two lenses. The rotation trough 21 comprises an end face, a second chamber, and an opening, and the at least two lenses are disposed in the second chamber. The opening of the rotation trough 21 is disposed towards the light-emitting assembly 3. A transparent plate 23 is connected to the end face, and one end of each of the at least two lenses is connected to the transparent plate 23. The light-emitting assembly 3 comprises three light-emitting diodes (LEDs) 31, and the number of the at least two lenses is twice that of the LEDs. The rotation trough 21 is rotatable with respect to the light-emitting assembly 3, and the projection of the rotation path of all of the at least two lenses on the light-emitting assembly 3 covers the LEDs 31.

The central axis of the transparent plate 23 coincides with the central axis of the rotation trough 21. The end face of the transparent plate 23 and the end face of the rotation trough 21 away from the light-emitting assembly 3 form a step. The end face of the transparent plate 23 away from the light-emitting assembly 3 protrudes to form six adjusting blocks 24. The front cover 1 further comprises a clamping block 12 circumferentially disposed on one end of the first chamber away from the light-emitting assembly 3, and the clamping block 12 is in contact with the step. The edge of the end face of the rotation trough 21 away from the light-emitting assembly 3 comprises a plurality of arc grooves 25. The clamping block 12 comprises a plurality of arc protrusions 21 raised towards the rotation trough 21. The plurality of arc protrusions 21 is disposed in the plurality of arc grooves 25, respectively, thereby securing the lens assembly on the front cover and. The end face of the transparent plate 23 away from the light-emitting assembly 3 comprises an indicating block 26, and the end face of the front cover 1 away from the rear cover 4 comprises two identification protrusions 15. The indicating block 26 is aligned with one of the two identification protrusions 15 in the radial direction.

The side wall of the first chamber of the front cover comprises two locating slots 13, and the side wall of the light-emitting assembly 3 protrudes to form two locating blocks 32. The two locating blocks 32 are disposed in the two locating slots 13, respectively. The side wall of the first chamber of the front cover further comprises at least two through holes 14, and the side wall of the rear cover 4 comprises at least two raised blocks 42. The at least two raised blocks 42 are disposed in the at least two through holes 14, respectively. The rear cover 4 comprises an opening facing the light-emitting assembly 3 and a base plate. The base plate comprises three support rods 41, and the three support rods 41 abut against the end face of the light-emitting assembly 3.

In certain embodiments, the three light-emitting diodes of the light-emitting assembly are disposed circumferentially along the central axis of the light-emitting assembly 3, and six lenses are disposed circumferentially along the central axis of the transparent plate 23. The six lenses comprise three first lenses 22*a* having a beam angle of 12 degrees, and three second lenses 22*b* having a beam angle of 36 degrees. The operator can adjust and switch the beam angle of the lamp assembly by rotating the rotation trough 21 between 12° and 36°. The beam angle 12° is suitable for long-distance lighting, and the lamp assembly can provide long-distance lighting. The beam angle 36° is suitable for short-distance lighting or lighting for development areas, and the lamp assembly provide a wide range of lighting.

One of the two identification protrusions 15 corresponds to the beam angle 12°, and the other corresponds to the beam angle 36°. When the lamp leaves the factory, it has a 12° beam angle, and one end of each of the three first lenses 22*a* away from the transparent plate 23 faces the three LEDs 31, and the indicating block 26 points to the identification protrusion 15 corresponds to the beam angle 12°. When the operator rotates the rotation trough 21 by 60° counterclockwise, the three second lenses 22*b* with 36° beam angle replace the three first lenses 22*a* with 12° beam angle, and the ends of the three second lenses 22*b* away from the transparent plate 23 face the three LEDs 31 respectively. The operator rotates the rotation trough 21 clockwise by 60° and the lamp can be switched back to 12° beam angle.

Figure 6:
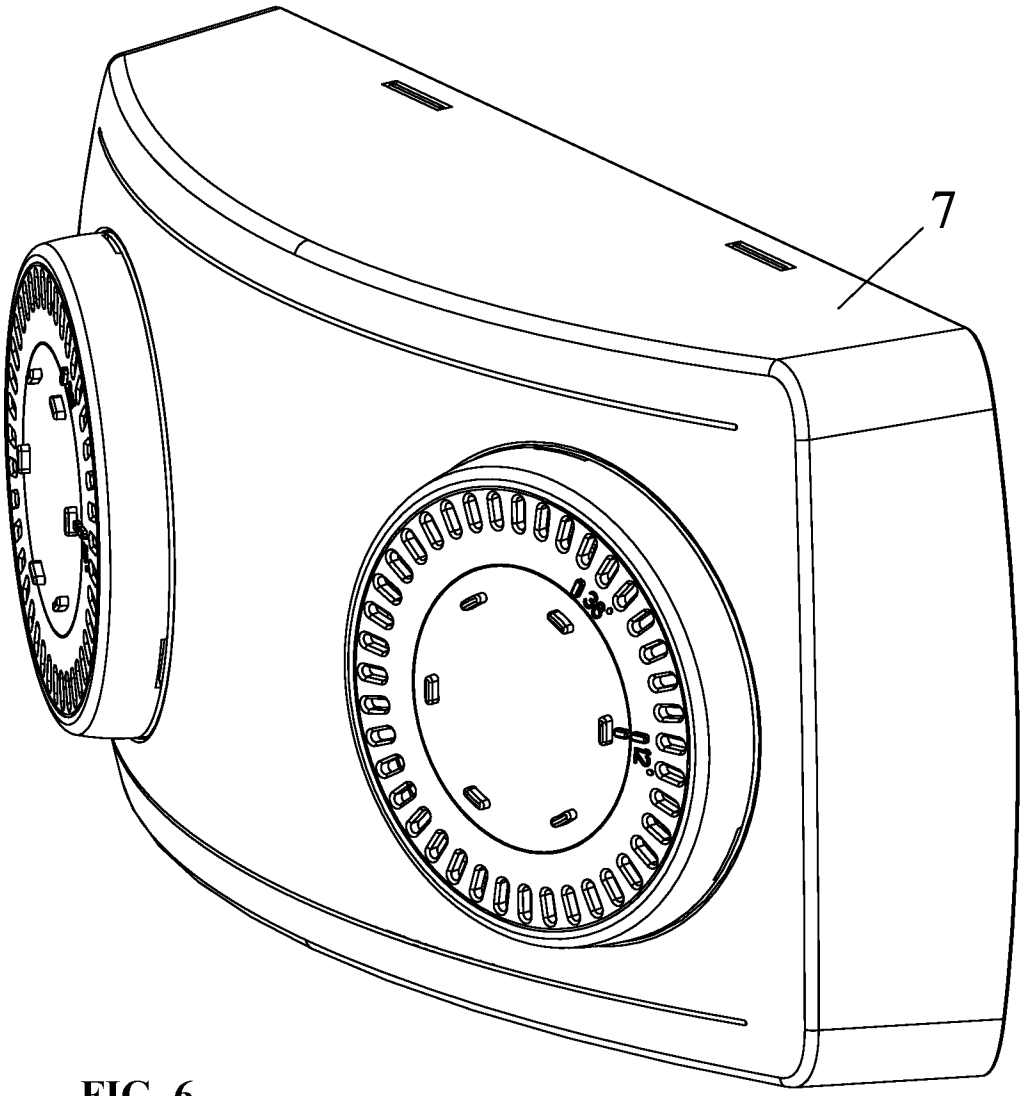
FIG. 6 is a schematic diagram of an emergency lamp according to one embodiment of the disclosure.
Figure 7:
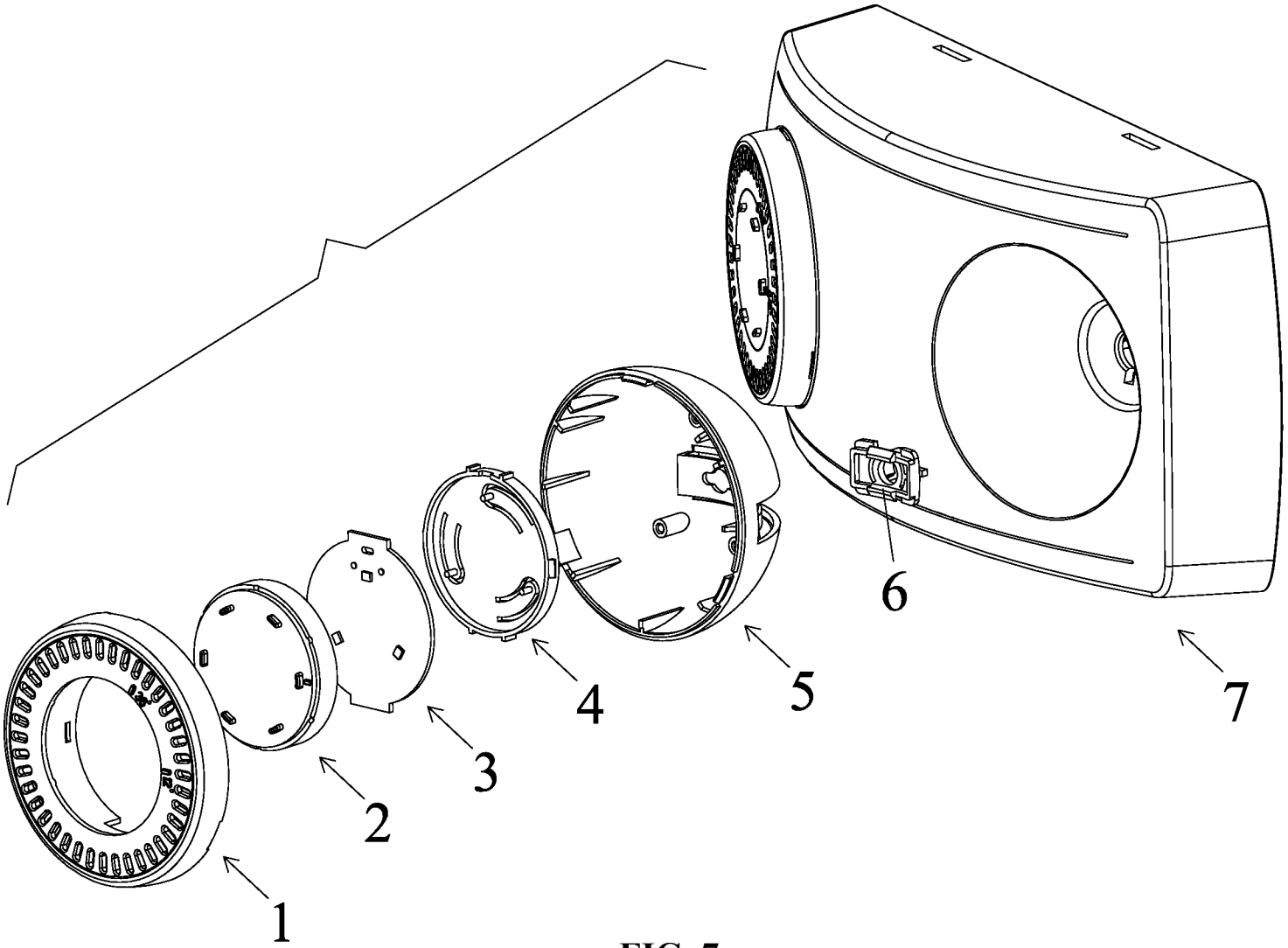
FIG. 7 is an exploded view of an emergency lamp according to one embodiment of the disclosure.

As shown in FIGS. 6-7, the disclosure also provides an emergency lamp. The emergency lamp comprises a body 7 and two abovementioned lamp assemblies. Each lamp assembly is disposed on a lamp holder 5. The lamp holder is connected to the body 7 via a rotating base 6. The body 7 comprises a curved mounting surface, and the two lamp assemblies are disposed on two ends of the curved mounting surface, respectively. The two lamp assemblies illuminate in two different directions, thus increasing the illumination range.

It will be obvious to those skilled in the art that changes and modifications may be made, and therefore, the aim in the appended claims is to cover all such changes and modifications.

What is claimed is:

1. A lamp assembly, comprising:

a front cover;

a lens assembly;

a light-emitting assembly; and a rear cover;

wherein:

the front cover and the rear cover are connected to each other to form a cavity, and the lens assembly and the light-emitting assembly are disposed in the cavity;

the front cover comprises a first chamber; the first chamber runs through the front cover and the lens assembly is disposed in the first chamber;

the lens assembly comprises a rotation trough and at least two lenses;

the rotation trough comprises an end face, a second chamber, and an opening, and the at least two lenses are disposed in the second chamber; the opening of the rotation trough is disposed towards the light-emitting assembly; a transparent plate is connected to the end face, and one end of each of the at least two lenses is connected to the transparent plate;

the light-emitting assembly comprises at least one light-emitting diode (LED), and the number of the at least two lenses is twice that of the at least one LED; and the rotation trough is rotatable with respect to the light-emitting assembly, and a projection of a rotation path of all of the at least two lenses on the light-emitting assembly covers the at lest one LED.

2. The lamp assembly of claim 1, wherein a central axis of the transparent plate coincides with a central axis of the rotation trough; an end face of the transparent plate and the end face of the rotation trough away from the light-emitting assembly form a step; the end face of the transparent plate away from the light-emitting assembly protrudes to form a plurality of adjusting blocks.

3. The lamp assembly of claim 2, wherein the front cover further comprises a clamping block circumferentially disposed on one end of the first chamber away from the light-emitting assembly, and the clamping block is in contact with the step; an edge of the end face of the rotation trough away from the light-emitting assembly comprises a plurality of arc grooves; the clamping block comprises a plurality of arc protrusions raised towards the rotation trough; and the plurality of arc protrusions is disposed in the plurality of arc grooves, respectively.

4. The lamp assembly of claim 3, wherein the end face of the transparent plate away from the light-emitting assembly comprises an indicating block, and an end face of the front cover away from the rear cover comprises a plurality of identification protrusions; and the indicating block is aligned with one of the plurality of identification protrusions in a radial direction.

5. The lamp assembly of claim 1, wherein a side wall of the first chamber of the front cover comprises at least two locating slots, and a side wall of the light-emitting assembly protrudes to form at least two locating blocks; the at least two locating blocks are disposed in the at least two locating slots, respectively.

6. The lamp assembly of claim 1, wherein a side wall of the first chamber of the front cover comprises at least two through holes, and a side wall of the rear cover comprises at least two raised blocks; the at least two raised blocks are disposed in the at least two through holes, respectively.

7. The lamp assembly of claim 1, wherein the rear cover comprises an opening facing the light-emitting assembly, and a base plate; the base plate comprises a plurality of support rods, and the plurality of support rods abuts against an end face of the light-emitting assembly.

8. The lamp assembly of claim 1, wherein the light-emitting assembly comprises three light-emitting diodes disposed circumferentially along a central axis of the light-emitting assembly, and six lenses are disposed circumferentially along a central axis of the transparent plate.

9. An emergency lamp, comprising the lamp assembly of claim 1.

10. The emergency lamp of claim 9, comprising two lamp assemblies, and central axes of two transparent plates of the two lamp assemblies form an included angle.

* * * * *